US005499588A

United States Patent [19]

Card et al.

[11] Patent Number: 5,499,588

[45] **Date of Patent: * Mar. 19, 1996**

[54] METHOD AND APPARATUS FOR PRODUCING TUFTS IN LONGITUDINAL LINES

[75] Inventors: Roy T. Card, Chattanooga, Tenn.; Wilton Hall, Fort Oglethorpe, Ga.

[73] Assignee: Card-Monroe Corp., Chattanooga, Tenn.

[ * ] Notice: The portion of the term of this patent subsequent to Jul. 6, 2010, has been disclaimed.

[21] Appl. No.: 275,077

[22] Filed: Jul. 14, 1994

Related U.S. Application Data

[63] Continuation of Ser. No. 66,780, May 24, 1993, abandoned, which is a continuation of Ser. No. 934,292, Aug. 24, 1992, Pat. No. 5,224,434, which is a continuation of Ser. No. 653,766, Feb. 11, 1991, abandoned.

[51] Int. Cl.[6] ..... D05C 15/30

[52] U.S. Cl. ..... 112/80.41; 112/80.52; 112/475.23

[58] Field of Search ..... 112/80.41, 80.52, 112/80.55, 80.7, 80.5, 266.2, 475.23

[56] References Cited

U.S. PATENT DOCUMENTS

| | | | |
|---|---|---|---|
| 3,919,953 | 11/1975 | Card et al. . | |
| 4,226,196 | 10/1980 | Booth | 112/80.41 |
| 4,366,761 | 1/1983 | Card | 112/80.41 |
| 4,754,718 | 7/1988 | Watkins | 112/80.52 |
| 4,800,828 | 1/1989 | Watkins | 112/80.41 |
| 5,224,434 | 7/1993 | Card et al. | 112/80.41 |

*Primary Examiner*—Paul C. Lewis
*Attorney, Agent, or Firm*—Hopkins & Thomas

[57] ABSTRACT

Front and rear needle bars are provided with front and rear needles for inserting yarns into a backing material. An excess of front loopers are provided for the front needles and an excess of rear loopers are provided for the rear needles. The front loopers respectively face the rear loopers and are respectively aligned with each other. The needle bars are shifted laterally so as to provide longitudinal rows of tufts formed by the front needles providing spacing between the tufts of a longitudinal row which space is filled in by the tufts of rear needles.

6 Claims, 3 Drawing Sheets

METHOD AND APPARATUS FOR PRODUCING TUFTS IN LONGITUDINAL LINES

CROSS REFERENCE TO RELATED APPLICATIONS

This application is a continuation of application Ser. No. 08/066,780, filed May 24, 1993, now abandoned, which was a continuation of application Ser. No. 07/934,292, filed Aug. 24, 1992 (now U.S. Pat. No. 5,224,434), which was a continuation of application Ser. No. 07/653,766, filed Feb. 11, 1991, now abandoned.

BACKGROUND OF THE INVENTION

This invention relates to tufting machines and is more particularly concerned with an apparatus and method for producing tufts from different yarns in common longitudinal rows.

In the past, the tufting industry has long sought for an easy and efficient way of producing tufts from different yarn in selected single, longitudinal rows. Thus, stop needle machines were produced in which the needles of the tufting machine were aligned longitudinally but were selectively operated so that one needle sewed a portion of a longitudinal row while the other was stopped. Such machines were impractical for high speed tufting and were expensive to build, maintain and program.

Another form of prior art tufting machine which could produce tufts of different characteristics was the machine which had "cut-loop loopers." Such a machine had a cut pile looper with a spring clip which enabled the yarn feed mechanism to control, by the amount of yarn feed to the needle, whether the yarn formed a cut pile or a loop pile. The successive tufts in a longitudinal row, however, had to be from a single yarn and precluded multicolor tufts from different yarns in a single row.

Another form of providing a multicolored appearance in a tufted product was by producing high cut pile tufts in one row to overlie low loop pile in an adjacent row.

Still another method of tufting to produce a multicolored pattern involved the use of laterally shiftable front and back needle bars which enabled the needles of one needle bar to be moved so as to cooperate, selectively, with different laterally spaced loopers. All needles were inserted into the backing material for each reciprocation, however, the needles of one needle bar were always staggered with respect to the needles of the other needle bar and the front loopers were staggered with respect to the rear loopers. In such prior art machines, the shift of one needle bar with respect to the other, had to be a lateral distance equal to at least two gauges of tufting. U.S. Pat. No. 4,366,761 illustrates such a machine. The shifting by two gauges causes the accumulation of excessive yarns in the back stitches. By having to shift one needle bar two gauges with respect to the other, this prevented making a continuous diagonal row of tufts, using a selected yarn or yarns. Therefore, a diagonal line of tufting in a tufted product has had to appear as broken lines, formed by a succession of spaced discrete pin dots.

SUMMARY OF THE INVENTION

Briefly described, the present invention includes a tufting machine having pairs of longitudinally aligned loopers for cooperating with laterally shiftable needle bars. At times, the needles of one needle bar are longitudinally aligned with the needles of the second needle bar. Also at times, there are an excess of loopers for each row of needles, some or all of which are longitudinally aligned. The loopers can have a more narrow gauge than the needles so that longitudinal rows of the backing can be shared, thereby permitting a shift of a single gauge by either needle bar. This single gauge, lateral shifting enables the machine to produce a wide variety of fabrics which include diagonal rows formed of one or a plurality of yarns.

It is an object of the present invention to provide a tufting machine which can produce longitudinal rows of tufts, in which each longitudinal row can contain cut and uncut tufts of different yarns.

Another object of the present invention is to provide a tufting machine which can tuft different sizes or types of yarn as loop or cut pile in the same longitudinal row or rows.

Another object of the present invention is to provide a tufting machine which can provide one or more cut or looped tufts in adjacent rows.

Another object of the present invention is to provide a tufting machine which is capable of producing carpeting having a multitude of colors and textured patterns achieved through varying the threading and varying the shift sequence of the needle bars.

Another object of the present invention is to provide a tufting machine and a process of tufting which requires no buried or hidden short loops in order to produce patterned tufted fabrics which can contain cut tufts and looped tufts of uniform or different heights and different colored yarns.

Another object of the present invention is to provide a tufting machine and method of tufting in which the tufted fabric retains a full density of face yarn throughout the fabric.

Another object of the present invention is to provide a tufting machine and method of tufting which will minimize the amount of yarn in the back stitches, due to shifting of the needle bars.

Another object of the present invention is to provide a tufting machine and method of tufting in which the diagonals appearing in the pattern of the tufted fabric can be created by either a single or a plurality of yarn or yarns of a color different from the other yarns in the fabric.

Another object of the present invention is to provide a tufting machine and process of tufting which will produce longitudinal rows of cut pile with one, two, or three adjacent yarns and with loop pile yarns which have been shifted over the back stitch of the straight row or rows and vice-versa.

Another object of the present invention is to provide a tufting machine and method of tufting which can produce adjacent longitudinal rows of loop and cut pile without shifting of the fabric and which will retain the maximum density of the face yarn of the fabric.

Another object of the present invention is to provide a tufting machine and method of tufting which can obtain a tip sheared look (which, in the prior art, was achieved by shearing the high loops) without the extra step of tip shearing and without any appreciable loss of yarn.

Another object of the present invention is to provide a tufting machine and method of tufting which will produce a tufted fabric having a uniformly, random tip sheared look.

Another object of the present invention is to provide a tufting machine and method of tufting in which the needles can be shifted a single or a multiple of a single gauge, namely one, two, three or four gauges.

Another object of the present invention is to provide a tufting machine in which there can be longitudinal rows of loop pile and cut pile of different yarns and wherein the loop pile tufts are not thrust through the cut pile tufts.

Another object of the present invention is to provide a tufting machine and method of tufting in which the gauge integrity of the resulting fabric is maintained.

Another object of the present invention is to provide a tufting machine and method of tufting which will produce a tufted fabric having a woven Wilton appearance.

Another object of the present invention is to provide a tufting machine which can produce patterns and diagonals in a tufted fabric and still run at a standard tufting speed.

Another object of the present invention is to provide a tufting machine and method of tufting which will produce patterns and diagonals in the tufted product and can still run off of beams which save space in the plant and reduce waste (both in the tubes and on the cones of the creels) and are capable of making shorter rows, economically.

Another object of the present invention is to provide a tufting machine and method of tufting in which the pattern produced in the face yarns can be varied in color and texture or can be in texture only (cut pile and loop pile) or in color variations from cut pile with respect to loop pile.

Another object of the present invention is to provide a tufting machine and method of tufting which can be used for producing patterned goods from different sizes or types of yarns in the loop tufts and also in size and type in the cut pile, whereby various colors of yarns may be used or various twist levels of different types of yarns may be used.

Another object of the present invention is to provide a tufting machine in which different mixes of needles can be arranged on a plurality of needle bars, the needles being grouped for example in three adjacent needles on one bar for providing space capable of being filled in by the needles of the other needle bar.

Another object of the present invention is to provide a tufting machine and method of tufting which can make cut or uncut tufts in the central portion of the fabric or produce pin dots in the central portion and all loops or all cut tufts in the borders of the fabric.

Another object of the present invention is to provide a tufting machine and method of tufting in which the center portion of the tufted fabric can be all loop pile and the borders can be all cut pile or vice-versa.

Other objects, features, and advantages of the present invention will become apparent from the following description when taken in conjunction with the accompanying drawings wherein like characters of reference designate corresponding parts throughout the several views.

DETAILED DESCRIPTION

Figure 1:
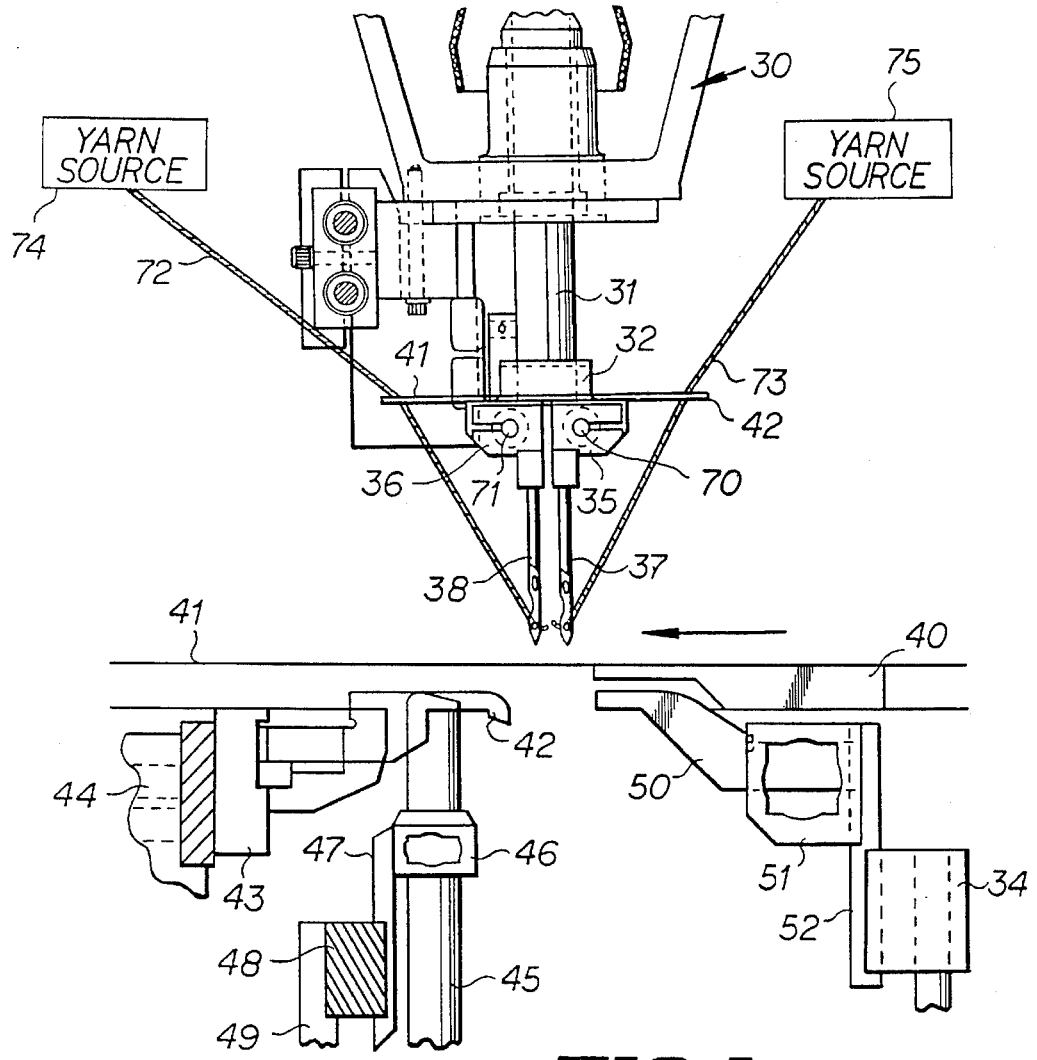
FIG. 1 is a fragmentary vertical sectional view of a tufting machine constructed in accordance with the present invention.

Referring now in detail to the embodiment chosen for the purpose of illustrating the present invention, numeral 30 in FIG. 1 indicates generally a conventional tufting machine which has push rods 31 which are reciprocated along their respective axes upwardly and downwardly, the push rods being provided at their lower end with a transversely extending needle bar support 32. The needle bar support 32 has, along its lower surface, a pair of transversely extending, laterally shiftable, parallel needle bars 35 and 36. The front needle bar 35 is provided with a row of transversely aligned, front needles 37 and the rear needle bar 36 is provided with a row of transversely aligned rear needles 38.

The tufting machine 30 also has a bed 40, over which the backing material 41 passes, the backing material 41 being disposed beneath the needles 37 and 38, so that the needles 37 and 38 simultaneously insert yarns 72 and 73 through the backing material, upon reciprocation of the needle bar support 32.

Below the backing material 41 the tufting machine 30 in FIG. 1 is provided with a plurality of cut pile loopers 42 the bills of which extend forwardly opposite to the direction of travel of the backing material 41 and cooperate with the rear needles 38 so as to catch and hold the loops of yarn sewn by these needles 38. These cut pile loopers 42 are carried by looper block 43 supported by a rocker assembly, denoted generally by the numeral 44. According to the present invention, the number of loopers 42 may and usually do exceed, substantially, the number of needles 38 and are of a more narrow gauge than the gauge spacing of needles 37.

Each looper 42 is provided with cut pile knife blade 45 carried by a block, such as block 46, the block 46 being supported at one end of a staff 47 which extends upwardly from the staff supporting bar 48 on a knife rocker assembly, denoted generally by numeral 49. The loops of yarn gathered by loopers, such as looper 42, are urged rearwardly of the machine 30 as they are carried by the backing material 41 and so that the loops are eventually pulled into the path of the knife blades, such as blade 45, and are severed or cut while they remain on the cut pile loopers 42. Thus all of the tufts accumulated on the cut pile loopers 42 will eventually be cut pile tufts.

Forwardly of the cut pile loopers 42 are the loop pile loopers, such as looper 50 in FIG. 1, each looper 50 being carried by a looper block 51 supported on a staff 52, from a loop pile rocker assembly, denoted generally by numeral 34.

Figure 2:
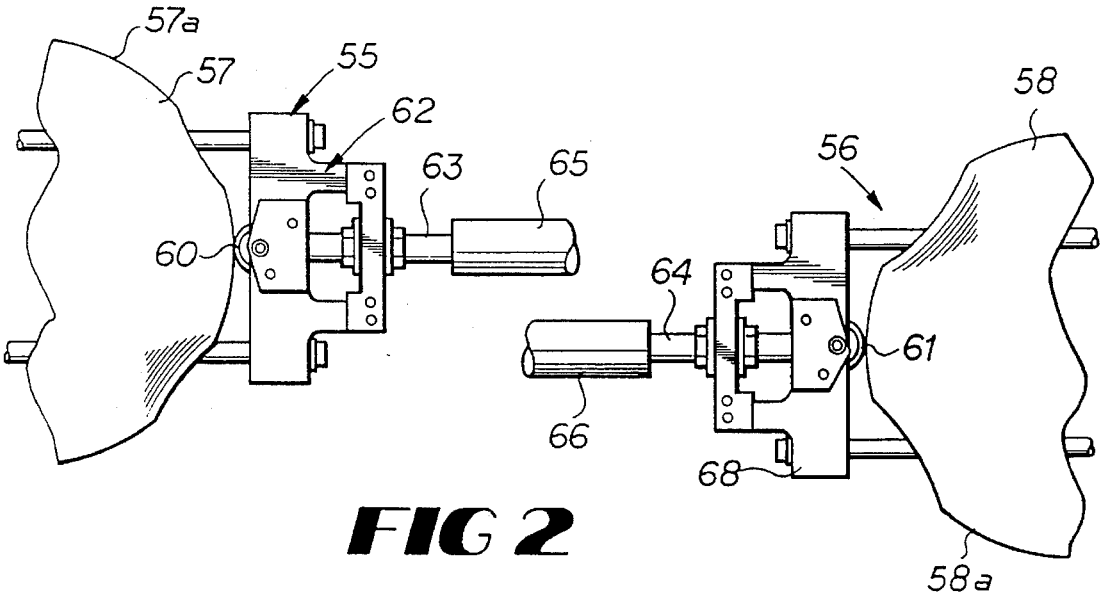
FIG. 2 is a fragmentary side elevational view showing the two needle bar control members which respectively control the lateral shifting of the needle bars of the tufting machine illustrated in FIG. 1.

In the present invention, the needle bars 35 and 36 are controlled by a pair of needle bar shift controls, denoted by the numerals 55 and 56 in FIG. 2. The needle bar shift control 55 includes a rotatable cam disc 57, rotatable about a fixed axis, the disc 57 being provided with a peripheral cam surface 57*a* having recesses and protrusions. A cam follower 60 rides along the peripheral cam surface 57*a* of the disc 57 and is carried by a shiftable frame 62. A second cam follower (not shown) is diametrically opposed to follower 60, also on frame 62. In like fashion, a second cam disc 58 has a peripheral cam. surface 58*a* which engages cam followers, such as cam follower 61 to move a frame 68.

As seen in FIG. 2, the cam discs 57 and 58 are adapted to control, respectively, the lateral shifting of the needle bars 35 and 36, the peripheries of the disc forming camming surfaces 57*a* and 58*a*, respectively.

Cam followers, such as cam followers 60 and 61, on the respective shift frames 55 and 56, ride along the peripheries 57*a* and 58*a* of disc 57 and 58 so as to move the frames 62 and 68 laterally, as dictated by the peripheries 57*a* and 58*a*. The frames 62 and 68, in turn, are connected, via push rods 63 and 64, to links 65 and 66. Links 65 and 66, in turn, manipulate respectively the control rods 70 and 71, seen in FIG. 1, which protrude from the ends of needle bars 35 and 36.

Yarns 72 and 73 from yarn sources 74 and 75, such as creels or beams, are withdrawn at uniform rates and passed through yarn guides 41 and 42 to the needles 37 and 38, the yarns 72 being fed to the back or rear transverse row of needles 38 and the yarns 73 being fed to the front transverse row of needles 37. Patterned high-low loop tufts can be readily produced by substituting a conventional yarn control mechanism for the yarn source 75.

Figure 3:
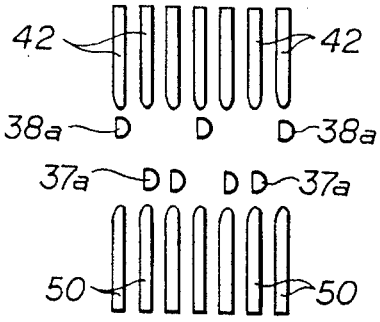
FIG. 3 is a schematic horizontal sectional view of the needles and the needle bars of the tufting machine shown in FIG. 1.
Figure 4:
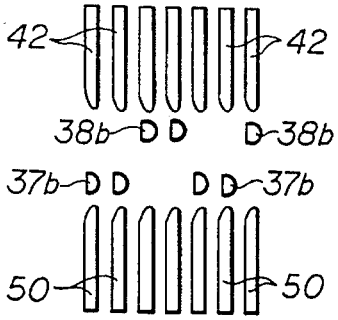
FIG. 4 is a view similar to FIG. 3 but showing a different spacing of the needles in the two needle bars.
Figure 5:
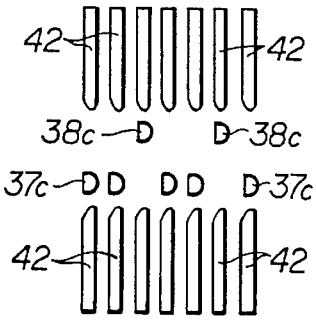
FIG. 5 is a view similar to FIGS. 3 and 4 and showing still another spacing of the needles of the two needle bars.
Figure 6:
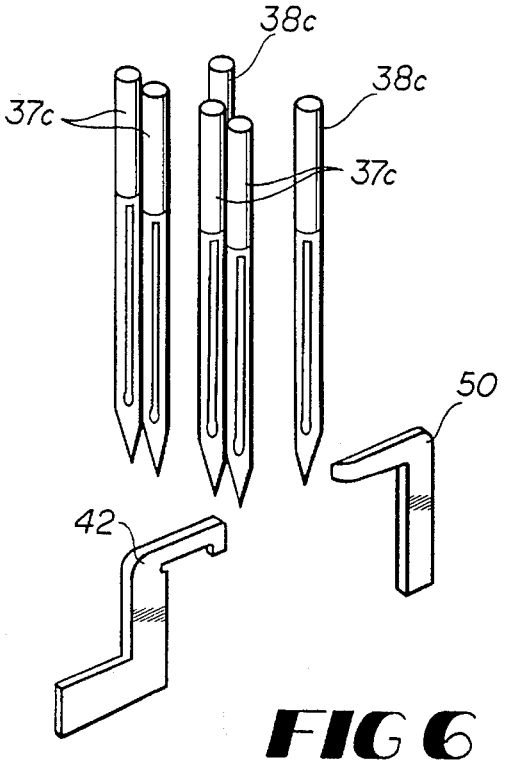
FIG. 6 is a fragmentary perspective view of some of the needles depicted in FIG. 5, associated with their loopers.

An important feature of the present invention is that the bills of front loopers 50 are respectively aligned with the bills of rear loopers 42. In FIG. 3, 4 and 5 are shown different arrangements of needles 37 and 38 with respect to the loopers 42 and 50, the needles which are substituted for front needles 37 being labeled needles 37*a*, 37*b*, 37*c* and the needles substituted for needles 38 being labeled 38*a*, 38*b*, and 38*c*.

In FIG. 3 pairs of needles 37*a* are spaced from each other by a spacing twice as wide as the spacing of their associated loopers 50 and the rear needles 38*a* are spaced from each other by a spacing which is three times the spacing of its associated loopers 42. Thus, through appropriate lateral shifting of one or both needle bars 35 and 36 for the needles 37*a* and 38*a*, by one, two or three loopers, left or right, only one needle 37*a* or needle 38*a* is sewing in a prescribed longitudinal row.

In FIG. 4, the front needles 37*b*, are arranged in spaced pairs along the transverse length of the tufting machine whereby the axes of the needles 37*b* of each pair are one gauge apart and the space between the axes of the adjacent needles 37*b* in adjacent pairs are spaced apart by a plurality (two) gauges.

The center lines of the adjacent front loop pile loopers 50 are all evenly transversely spaced apart by a single gauge while the center lines of the adjacent cut pile loopers 42 are evenly transversely spaced apart by a single gauge, the loop pile loopers 50 being respectively longitudinally aligned with each other.

The front loop pile loopers 50 are all in transverse alignment with each other and the cut pile loopers 42 are transversely aligned with each other. Furthermore, all of the cut pile loopers 42 rock forward as the loop pile loopers 50 rock forwardly and vice versa. The loopers 42 and 50 do not move laterally but simply rock toward and away from each other. Thus, when a needle 37*a*, 37*b* or 37*c* is appropriately positioned laterally, by one, two or three or more gauges, it is moved downwardly adjacent a prescribed looper 50 so that a loop of yarn 73 will be caught and momentarily held by the looper 50 and released after the needle 37*a*, 37*b* or 37*c* is retracted from backing 41.

In like fashion, the needles 38*a*, 38*b* or 38*c* are shifted laterally by one, two or three or more gauges and are moved downwardly, and their yarns are caught and cut by the cut pile looper assembly.

To synchronize the cams, the actions of the rear cam should be delayed from the action of the front cam, so that with a ⅜" stagger for the needles and 8 stitches per inch, there should be a 3 stitch cam delay for the back cam with respect to the front cam; with 10.68 stitches/inch there should be a 4 stitch cam delay for the back cam with respect to the front cam; and with 13.33 stitches/inch there should be a 5 stitch cam delay between the front and back cam. With 16 stitches/inch a 6 stitch cam delay is required.

This is calculated in that a stagger of 0.375 inches or ⅜ inches divided by cam delay in revolutions equals the length of each stitch. Thus, the longitudinal distance between the center lines of front and back rows of needles, divided by the cam delay in revolutions of the machine equals the longitudinal distance between adjacent stitches (length of each stitch).

In FIG. 3 it is seen that the rear needles 38*a* are spaced from each other so as to provide one needle for every third looper 42 and that each of the front needles are arranged in adjacent pairs, there being a space of one looper between each pair of adjacent needles. By such an arrangement, the fabric depicted in FIGS. 7 and 8 may be provided. Thus, without shifting the front needle bar, spaced rows of loop pile tufts 137*a* are sewn along spaced, parallel lines and the cut pile tufts 138*a* are produced by lateral shifting of the rear needle bar so as to produce in the backing material 41*a* a plurality of cut pile tufts in which the yarns 72 form the back stitches seen in FIG. 8 and the yarns 73 form the loop pile tufts 137*a*.

Figure 8:
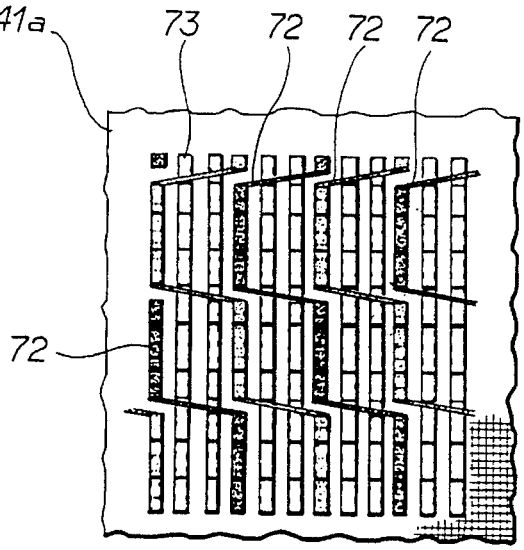
FIG. 8 is a fragmentary schematic bottom plan view of the fabric depicted in FIG. 7.

By laterally shifting the back needle bar only, the yarns 72, which are varied in color from the yarns 73 and can be varied in color from each other, produce a back stitch as indicated in FIG. 8 and the tufts indicated by numeral 138*a*, in the backing material 41*a*.

Figure 9:
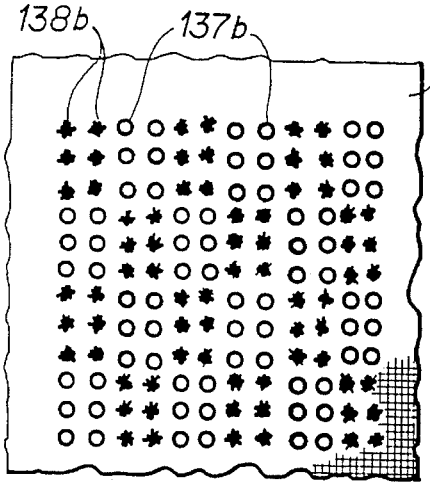
FIG. 9 is a fragmentary schematic plan view of the face yarns in fabric produced when the needles are arranged as shown in FIG. 4.
Figure 10:
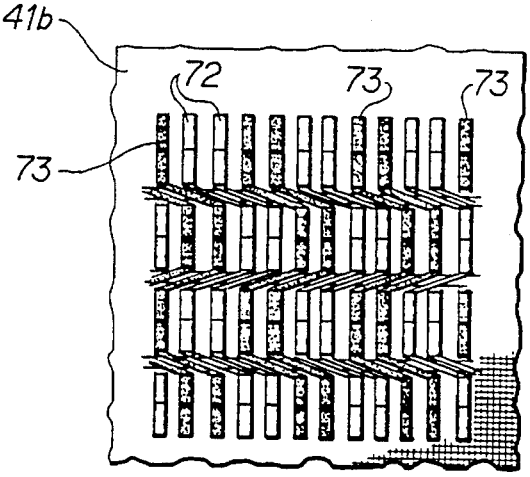
FIG. 10 is a fragmentary schematic bottom plan view of the fabric depicted in FIG. 9.

In FIGS. 9 and 10 is shown a tufting arrangement which is accomplished utilizing the needle spacing of FIG. 4. Here, by lateral shifting of both needle bars, the loop pile tufts 137*b* and the cut pile tufts 138*b* are produced in the backing material 41, the back stitching being formed by the yarns 72 and 73 as depicted in FIG. 10.

Figure 11:
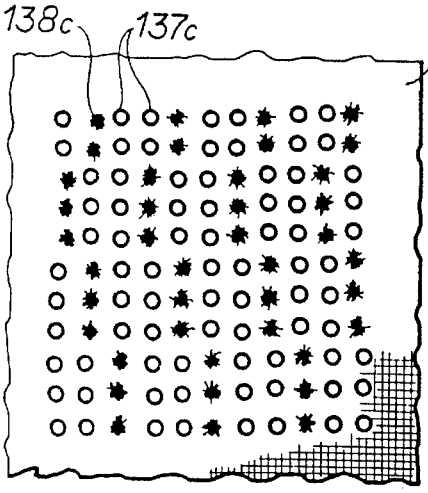
FIG. 11 is a fragmentary schematic plan view of the face yarns in fabric produced when the needles are arranged as shown in FIG. 5.
Figure 12:
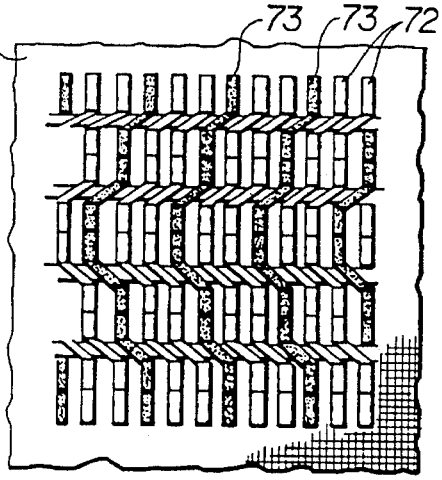
FIG. 12 is a fragmentary schematic bottom plan view of the fabric depicted in FIG. 11.

In FIGS. 11 and 12 are shown a pattern which can be produced utilizing the needle spacing depicted in FIG. 5. Here, the pairs of front needles 37*c* produce the tufts 137*c* as the back needles 38*c* produce the loop pile tufts 138*c*, the back stitching therefor being shown in FIG. 12. Here both needle bars are shifted and the yarns 72 produce the loop pile tufts 137*c* as the yarns 73 produce the cut pile tufts 138*c*.

Figure 7:
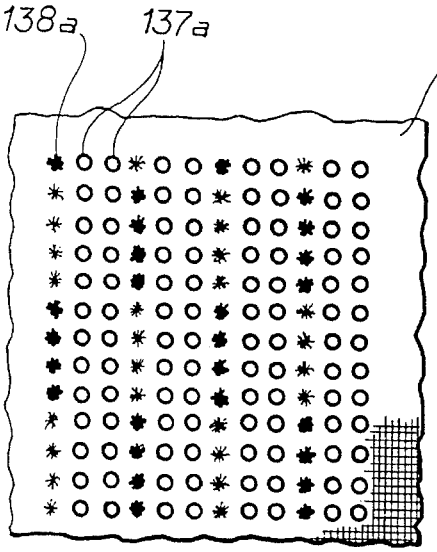
FIG. 7 is a fragmentary schematic plan view of the face yarns in fabric produced when the needles are arranged as shown in FIG. 3.

By providing a spacing of more than one looper between selected needles, and through appropriate shifting laterally of the needle bars, single longitudinal rows of tufts which selectively have both loop pile and cut pile are produced, as illustrated in FIGS. 7, 9, and 11.

It will be obvious to those skilled in the art that many variations may be made in the embodiment here chosen for the purpose of illustrating the present invention, without departing from the scope thereof as defined by the appended claims.

We claim:

1. A tufting machine having a frame through which a backing material is fed along a longitudinal path, a reciprocatable front needle bar disposed on one side of said backing material, transversely spaced front needles carried by said front needle bar for inserting first yarns carried by said front needles through said backing material for producing successive first tufts of first yarns in said backing material upon reciprocation of said front needle bar, a reciprocatable rear needle bar disposed on said one side of said backing material, transversely spaced rear needles carried by said rear needle bar for inserting second yarns carried by said rear needles through said backing material for producing successive second tufts of second yarns in said backing material upon reciprocation of said rear needle bar, means for reciprocating said front needle bar and said rear needle bar, a plurality of loopers cooperating with said front needles and said rear needles, said loopers having first bill portions and second bill portions for catching and holding the yarns carried by said front needles and the yarns carried by said rear needles when the needles are inserted through the backing material, said first bill portions cooperating with said front needles and said second bill portions cooperating with said rear needles, said first bill portions being respectively aligned longitudinally along the path of travel of said backing material with said second bill portions so that tufts of yarns sewn by said front needles and by said rear needles are sewn in individual longitudinal rows along said backing material, the front needles being arranged in front groups of needles which have a prescribed gauge spacing between needles in each front group, the spacing between adjacent needles in adjacent of said front groups of said front needles being greater than said prescribed spacing, such that when said front needle bar is reciprocated, to form first groups of first tufts and is shifted and reciprocated again according to a prescribed pattern to form second groups of first tufts, the first groups are transversely spaced from each other and the first groups are longitudinally spaced from the second groups; said rear needles also being arranged in groups of needles so that when said rear needle bar is reciprocated and shifted according to said prescribed pattern, said rear needles will supply second tufts substantially only in longitudinal spaces between adjacent of said groups of first tufts in the respective longitudinal rows of first tufts, thereby producing parallel longitudinal rows of tufts in which each row has first tufts and second tufts interspersed and in aligned succession with respect to each other;

means for shifting of said front needle bar and said rear needle bar transversely with respect to each other and with respect to said backing material in timed relationship to the travel of said backing material and to each other so that the front needles are at times selectively aligned with different of said first bill portions and the rear needles are at times selectively aligned with different of said second bill portions in producing the interspersed tufts of the longitudinal rows of tufts in said backing material.

2. The tufting machine defined in claim 1 wherein the groups of needles of said front needle bar and the groups of needles of said rear needle bar are of equal gauge.

3. The tufting machine defined in claim 1 wherein said loopers having said first bill portions are front loopers which engage said first yarns and said loopers having second bill portions are rear loopers which engage yarns sewn by said rear needles.

4. The tufting machine defined in claim 1 wherein the backing material feed is such that there are eight stitches per inch for the needles, a ⅜ inch stagger between the front needles and back needles, and said means for shifting said front needle bar and said back needle bar for providing a three stitch delay between the pattern sewn by the rear needles with respect to the pattern sewn by the front needles.

5. The tufting machine defined in claim 1 wherein there are 10.68 stitches per inch and said means for shifting includes a prescribed pattern which has a four stitch delay between the back needles and the front needles.

6. Method of tufting for producing tufts from different yarns in parallel longitudinal rows in a backing material comprising the steps of:

(a) feeding a backing material progressively along a longitudinal path of travel through a tufting machine;

(b) disposing adjacent to one side of said backing material a plurality of front needles transversely of said backing material and in spaced relationship to each other in which certain of said needles are transversely spaced from each other by a prescribed first gauge and certain of said needles are transversely spaced from each other by another and different gauge distance which is a multiple of said first gauge, for providing a transverse row of front needles, said front needles being threaded with first yarns;

(c) moving said backing material at a prescribed rate longitudinally through said tufting machine;

(d) reciprocating said front needles for simultaneously inserting said first yarns carried by said front needles successively through successive portions of said backing material for forming successive longitudinally spaced groups of tufts of first yarns disposed in longitudinal rows each group having therein uniform stitches per inch of backing material and spaces between adjacent groups in each longitudinal row;

(e) arresting said tufts of said first yarn and then releasing them;

(f) disposing a plurality of rear needles in a transverse row of rear needles adjacent to said first row of needles and adjacent to said one side of said backing material, said rear needles being threaded with second yarns;

(g) inserting said second yarns carried by said rear needles through said backing material for filling in the spaces between said groups of tufts of first yarns in said longitudinal rows;

(h) arresting said tufts of said second yarns and then releasing them; and (i) laterally shifting said front row of needles and said back row of needles with respect to each other according to a prescribed pattern so as to produce in the respective spaced, longitudinal rows, continuous tufts having first yarns from different front needles and having second yarns from different rear needles in said longitudinal rows and interspersed with each other to form respectively continuous longitudinal rows of tufts in which the longitudinal rows have successive essentially equally spaced tufts.

* * * * *